US006465943B2

(12) United States Patent
Nozawa et al.

(10) Patent No.: US 6,465,943 B2
(45) Date of Patent: Oct. 15, 2002

(54) WINDING APPARATUS AND WINDING METHOD OF DEFLECTION COIL, AND DEFLECTION YOKE THEREBY

(75) Inventors: Takahiro Nozawa, Ryugasaki (JP); Manabu Asayama, Oyama (JP)

(73) Assignee: Victor Company of Japan, Ltd., Kanagawa-ken (JP)

( * ) Notice: Subject to any disclaimer, the term of this patent is extended or adjusted under 35 U.S.C. 154(b) by 0 days.

(21) Appl. No.: 09/796,354

(22) Filed: Mar. 2, 2001

(65) Prior Publication Data

US 2001/0022500 A1 Sep. 20, 2001

(30) Foreign Application Priority Data

Mar. 7, 2000 (JP) ..... 2000-061616
Mar. 9, 2000 (JP) ..... 2000-064548

(51) Int. Cl.[7] ..... H01J 29/70
(52) U.S. Cl. ..... 313/440; 315/1; 335/213
(58) Field of Search ..... 315/1, 5.36, 370; 313/340, 344, 413, 440; 335/210, 213; H01J 29/70

(56) References Cited

U.S. PATENT DOCUMENTS 3,855,694 A * 12/1974 Van Der Heijde ..... 29/605
4,612,525 A * 9/1986 Sluyterman et al. ..... 335/213
5,013,964 A * 5/1991 Vink et al. ..... 313/440
5,340,044 A * 8/1994 Doomernik et al. ..... 242/7.03
5,408,163 A * 4/1995 Milili et al. ..... 315/370
5,418,422 A * 5/1995 Vink et al. ..... 313/440
5,769,351 A * 6/1998 Van Den Berg et al. . 242/437.3
5,864,204 A * 1/1999 Ihm ..... 313/440
6,069,546 A * 5/2000 Azzi et al. ..... 335/210
6,150,910 A * 11/2000 Azzi et al. ..... 335/210

* cited by examiner

*Primary Examiner*—Don Wong
*Assistant Examiner*—Trinh Vo Dinh
(74) *Attorney, Agent, or Firm*—Connolly Bove Lodge & Hutz LLP

(57) ABSTRACT

Openings which are formed by dividing pins, are formed on a side section of a horizontal deflection coil within a range of 20 to 35% of a length of the horizontal deflection coil from a larger diameter flange and within an angle of 10 to 25 degrees to an X-axis. Other openings, which are formed by dividing pins are formed on the side section of the horizontal deflection coil within a range of 55 to 70% of a length of the horizontal deflection coil from the larger diameter flange and within an angle of 25 to 40 degrees to the X-axis.

9 Claims, 5 Drawing Sheets

WINDING APPARATUS AND WINDING METHOD OF DEFLECTION COIL, AND DEFLECTION YOKE THEREBY

BACKGROUND OF THE INVENTION

1. Field of the Invention

The present invention relates to a winding apparatus and a winding method of deflection coil such as a horizontal deflection coil and a vertical deflection coil utilized for a deflection yoke, and further relates to a deflection yoke manufactured by the winding apparatus and the winding method thereby.

2. Description of the Related Art

In a picture displaying apparatus utilizing a color picture tube of an inline three electron gun type, there existed one method, which utilizes a deflection yoke of a self-convergence system, out of several methods for converging three electron beams emitted from three electron guns on a screen or a picture excellently. Such a deflection yoke of self-convergence system is usually composed of a pair of upper and lower saddle shaped horizontal deflection coils and a pair of right and left saddle shaped vertical deflection coils, and then an excellent convergence characteristic can be obtained.

However, when a raster distortion appearing in upper and lower areas on a screen is adequately compensated in a color picture tube of an inline three electron gun type, a miss-convergence pattern shown in FIG. 1 is generated. In FIG. 1, a solid line represents a horizontal bright line of red (R) color, a broken line represents a horizontal bright line of blue (B) color, and an arrow "X" exhibits the horizontal direction of a screen. In other words, in an edge area of the screen in the vertical direction, the "R" is shifted upward more than the "B" in the first and third quadrants. In the second and fourth quadrants, the "R" is shifted downward more than the "B". Further, in a middle area of the screen in the vertical direction, The "R" is shifted downward more than the "B" in the first and third quadrants, and the "R" is shifted upward more than the "B" in the second and fourth quadrants. A pattern in the edge area is referred to reverse cross and a pattern in the middle area is referred to normal cross. Miss-convergence such that a cross pattern is reversed in the respective edge and middle areas is usually called reversal trilemma.

With respect to means for improving the trilemma, as disclosed in the Japanese Patent No. 2967683, for example, a method of combining a vertical deflection coil provided with a center tap with a diode switching circuit and other methods such that a saturable reactor connected to a horizontal deflection coil is combined with a diode switching circuit are realized.

Further, a convergence characteristic and a deflection distortion characteristic in a deflection yoke are extremely affected by locations and distributions of wires in a horizontal deflection coil and a vertical deflection coil (hereinafter referred as a deflection coil generically). Accordingly, a deflection coil of a deflection yoke, which is mass-produced commonly, obtains required characteristics by dividing a coil into a plurality of sections with controlling wire locations by a so called dividing pin and adjusting a location of each section and a number of windings when the wire is wound so as to form the coil.

A severer requirement is imposed on convergence and deflection distortion characteristics of a deflection yoke as a displaying apparatus has been in higher definition recently. In order to improve fundamental performances and flexibility of designing in response to the requirement, obtaining a more accurate characteristic is required by increasing a number of sections to be divided so as for a wire or coil allocation and wire distribution or winding distribution to be assigned minutely.

With reviewing a current method of improving the reversal trilemma first, a circuit for compensating the reversal trilemma and component parts such as a saturable reactor must be added by the current improving method. Accordingly, there existed some problems such that manufacturing cost will increase and manpower for assembling a deflection yoke will increase.

With examining a requirement for increasing dividing sections in a deflection coil next, a gap between dividing sections must be narrowed so as to increase a number of dividing sections of a deflection coil. In order to narrow the gap between dividing sections, a distance between dividing pins must be shortened. A dividing pin is controlled its putting in and out to a winding allocation by a pin driving device provided on a coil form of a winding apparatus. Accordingly, distances between the pin driving devices must be shortened so as to shorten the distance between the dividing pins. As far as adjacent pin driving devices interfere with each other, the distance between pin driving devices can not be shortened any more, as a matter of course, so that it is limited to shorten the distance between dividing pins. In other words, a distance between two dividing pins and a number of dividing pins are physically limited by a dimension of pin driving device being mounted on a coil form.

Therefore, a current winding apparatus and winding method of utilizing the winding apparatus sometimes can not realize a necessary number of dividing pins and their allocations and fails to improve performance of a deflection coil. Accordingly, there existed a problem such that a deflection yoke satisfying a severe requirement for the convergence characteristic and the deflection distortion characteristic can not be obtained.

SUMMARY OF THE INVENTION

Accordingly, in consideration of the above-mentioned problems of the prior art, an object of the present invention is to provide a winding apparatus and a winding method of a deflection coil such as a horizontal deflection coil and to provide a deflection yoke, which can improve the reversal trilemma without utilizing a circuit or a component part for compensating the reversal trilemma. Another object of the present invention is to provide a winding apparatus and a winding method of a deflection coil and a deflection yoke, which can improve flexibility of designing winding distribution of a deflection coil, and further can improve the convergence and deflection distortion characteristics.

In order to achieve the above object, the present invention provides, according to an aspect thereof, a winding apparatus having a convex form and a concave form for forming a horizontal deflection coil utilized for a deflection yoke being mounted on a neck portion of a color picture tube, wherein the horizontal deflection coil is formed by winding a wire in a winding space between the convex form and the concave form so that the neck portion corresponds to a smaller diameter section a screen side of the color picture tube corresponds to a larger diameter section, and an area connecting the smaller diameter section and the larger diameter section corresponds to a side section the winding apparatus includes: a plurality of dividing pins of regulating winding distribution in the side section being inserted in the winding space while winding the wire the plurality of dividing pins further includes: a first dividing pin provided within a range of 20 to 35% of a length between the larger diameter section and the smaller diameter section in a direction from the larger diameter section to the smaller diameter section and within an angle of 10 to 25 degrees to a horizontal axis of the screen and a line connecting the first dividing pin and an axial line of the color picture tube viewing from a cross section at a position of inserting the first dividing pin in the winding space; and a second dividing pin provided within a range of 55 to 70% of a length between the larger diameter section and the smaller diameter section in a direction from the larger diameter section to the smaller diameter section and within an angle of 25 to 40 degrees to the horizontal axis of the screen and a line connecting the second dividing pin and the axial line of the color picture tube viewing from a cross section at a position of inserting the second dividing pin in the winding space.

According to another aspect of the present invention, a winding method of deflection coil is provided. The winding method for forming a horizontal deflection coil utilized for a deflection yoke being mounted on a neck portion of a color picture tube, wherein the horizontal deflection coil is formed by winding a wire in a winding space between a convex form and a concave form, the neck portion corresponding to a smaller diameter section, a screen side of the color picture tube corresponds to a larger diameter section, and an area connecting the smaller diameter section and the larger diameter section as a side section the winding method regulates winding distribution in the side section by inserting a plurality of dividing pins in the winding space while winding the wire the plurality of dividing pins further includes: a first dividing pin being inserted within a range of 20 to 35% of a length between the larger diameter section and the smaller diameter section in a direction from the larger diameter section to the smaller diameter section and within an angle of 10 to 25 degrees to a horizontal axis of the screen and a line connecting the first dividing pin and an axial line of the color picture tube, viewing from a cross section at a position of inserting the first dividing pin in the winding space; and a second dividing pin being inserted within a range of 55 to 70% of a length between the larger diameter section and the smaller diameter section in a direction from the larger diameter section to the smaller diameter section and within an angle of 25 to 40 degrees to the horizontal axis of the screen and a line connecting the second dividing pin and the axial line of the color picture tube viewing from a cross section at a position of inserting the second dividing pin in the winding space.

According to a further aspect of the present invention, a deflection yoke is provided. The deflection yoke mounted on a neck portion of a color picture tube and equipped with a horizontal deflection coil, the neck portion corresponding to a smaller diameter section, a screen side of the color picture tube corresponding to a larger diameter section, and an area connecting the smaller diameter section and the larger diameter section as a side section the horizontal deflection coil includes: a plurality of openings being formed on the side section by regulating allocations of a plurality of dividing pins while a winding process of the horizontal deflection coil, the plurality of openings further having a first opening provided within a range of 20 to 35% of a length between the larger diameter section and the smaller diameter section in a direction from the larger diameter section to the smaller diameter section and within an angle of 10 to 25 degrees to a horizontal axis of the screen and a line connecting the plurality of dividing pins and an axial line of the color picture tube viewing from a cross section at a position of inserting the plurality of dividing pins in a winding space; and a second opening being provided within a range of 55 to 70% of a length between the larger diameter section and the smaller diameter section in a direction from the larger diameter section to the smaller diameter section and within an angle of 25 to 40 degrees to a horizontal axis of the screen and a line connecting between the plurality of dividing pins and the axial line of the color picture tube with viewing from a cross section at a position of inserting the plurality of dividing pins in the winding space.

According to a furthermore aspect of the present invention, a winding apparatus is provided. The winding apparatus having a convex form and a concave form for forming a horizontal deflection coil formed by winding a wire in a winding space between the convex form and the concave form the winding apparatus includes a plurality of dividing pins for dividing the horizontal deflection coil into a plurality of sections by regulating winding distribution by inserting the plurality of dividing pins into the winding space while winding the wire, wherein the plurality of dividing pins are inserted into the winding space from different directions alternately so as to form three adjacent sections in at least a part of the plurality of sections.

According to another aspect of the present invention, a winding method is provided. The winding method forms a deflection coil by winding a wire in a winding space between a convex form and a concave form, wherein the deflection coil is divided into a plurality of sections by inserting a plurality of dividing pins into the winding space so as to regulate winding distribution while winding the wire, and wherein the plurality of dividing pins are inserted into the winding space from different directions alternately so as to form three adjacent sections in at least a part of the plurality of sections.

According to a further aspect of the present invention, a deflection yoke is provided. The deflection yoke mounted on a neck portion of a color picture tube and equipped with a deflection coil with the neck portion corresponding to a smaller diameter section, a screen side of the color picture tube corresponding to a larger diameter section, and an area connecting the smaller diameter section and the larger diameter section as a side section, the deflection coil further has a plurality of openings formed on the side section by regulating allocations of a plurality of dividing pins while winding the deflection coil, wherein three adjacent sections in at least a part of the plurality of sections are divided by the plurality of dividing pins being inserted from different directions alternately.

Other objects and further features of the. present invention will be apparent from the following detailed description when read in conjunction with the accompanying drawings.

DETAILED DESCRIPTION OF THE PREFERRED EMBODIMENTS

[First Embodiment]

A first embodiment is provided for improving the reversal trilemma only by a magnetic field generated by a horizontal deflection coil.

Figure 1:
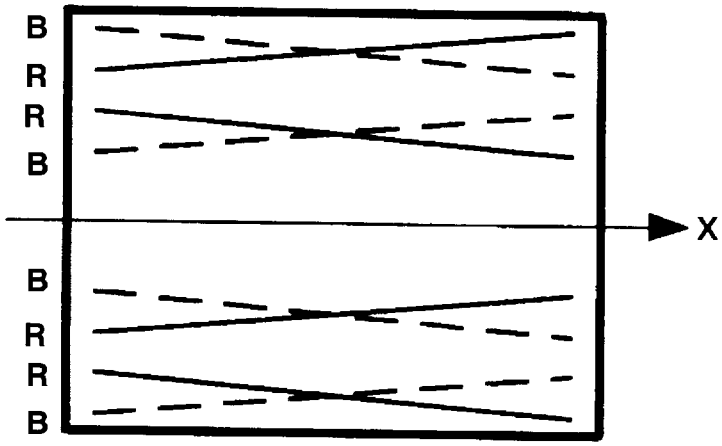
FIG. 1 shows a reversal trilemma.
Figure 2:
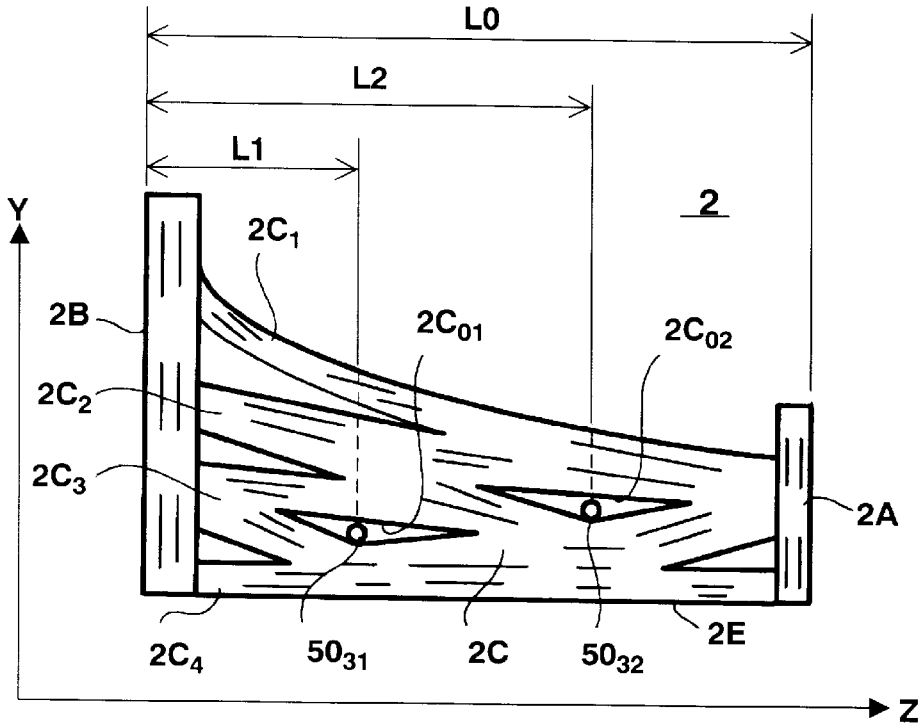
FIG. 2 is a side view of a horizontal deflection coil, which is suitable for improving the reversal trilemma shown in FIG. 1 and utilized in a deflection yoke, according to a first embodiment of the present invention.

FIG. 2 is a side view of a horizontal deflection coil, which is suitable for improving the reversal trilemma shown in FIG. 1 and utilized in a deflection yoke, according to a first embodiment of the present invention.

Figure 3:
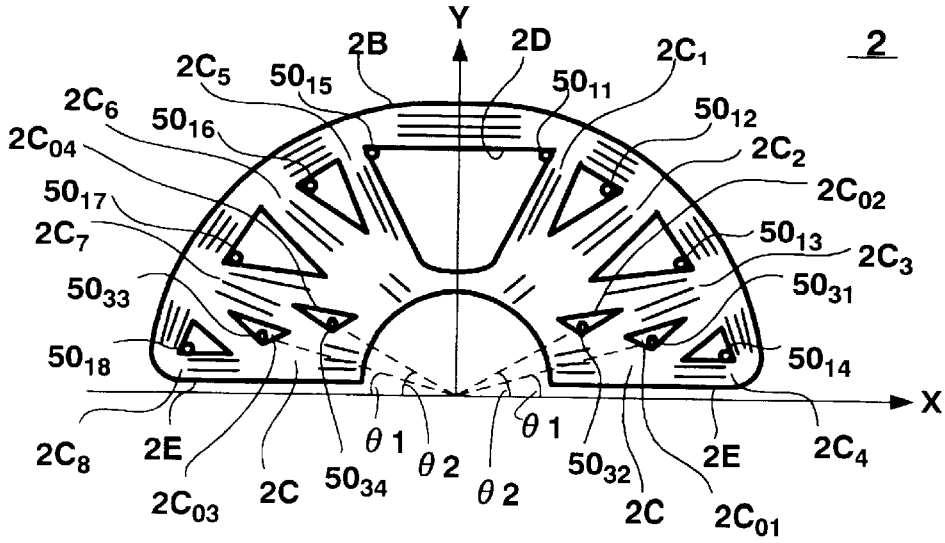
FIG. 3 is a front plan view of the horizontal deflection coil shown in FIG. 2.

FIG. 3 is a front plan view of the horizontal deflection coil shown in FIG. 2.

In FIG. 2, an arrow "Y" exhibits a vertical direction of a screen (hereinafter referred to an Y-axis) when the deflection coil is mounted on a color picture tube (not shown) and an arrow "Z" exhibits an axial direction of the color picture tube (hereinafter referred to a Z-axis). Further, FIG. 2 is a side view of the horizontal deflection coil 2 shown in FIG. 3 with viewing from the right side, and FIG. 3 is a front plan view of the horizontal deflection coil 2 with viewing from a screen side of the color picture tube (not shown), wherein an arrow "X" exhibits a horizontal direction of the color picture tube (hereinafter referred to an X-axis). The horizontal deflection coil 2 is symmetric with respect to the Y-axis, so that the left side of the horizontal deflection coil 2 shown from the left side of the horizontal deflection coil 2 of FIG. 3 is bilaterally symmetrical to the side view shown in FIG. 2.

In FIGS. 2 and 3, the horizontal deflection coil 2 comprises a flange in a smaller diameter or a smaller diameter flange 2A, another flange in a larger diameter or a larger diameter flange 2B, and a side section 2C connecting between the smaller diameter flange 2A and the larger diameter flange 2B. As shown in FIG. 3, a window section 2D is formed in a middle of the side section 2C, and a confronting section 2E at where two each of the horizontal deflection coil 2 is confronted each other is provided on a bottom surface of the horizontal deflection coil 2. In a case that the horizontal deflection coil 2 is wound by a winding apparatus, an allocation of a wire forming the horizontal deflection coil 2 is regulated by a pin so called as a dividing pin, and a required winding distribution is formed when the wire is wound so as to form the horizontal deflection coil 2. Further details of the winding apparatus will be depicted.

As shown in FIGS. 2 and 3, with defining that a total length of the horizontal deflection coil 2, that is, a length between the smaller diameter flange 2A and the larger diameter flange 2B is "L0", two dividing pins $\mathbf{50}_{31}$ and $\mathbf{50}_{33}$ are inserted in a position, which is allocated at a distance of "L1" from the larger diameter flange 2B, and two dividing pins $\mathbf{50}_{32}$ and $\mathbf{50}_{34}$ are inserted in another position, which is allocated at a distance of "L2" from the larger diameter flange 2B so as to regulate a position of a wire. Hereinafter these dividing pins $\mathbf{50}_{31}$ through $\mathbf{50}_{34}$ are called dividing pins $\mathbf{50}_{3}$ generically. Openings $\mathbf{2}C_{01}$ and $\mathbf{2}C_{03}$ are formed in a triangle shape of which a vertex faces toward the confronting section 2E at the locations of the dividing pins $\mathbf{50}_{31}$ and $\mathbf{50}_{33}$ respectively, and other openings $\mathbf{2}C_{02}$ and $\mathbf{2}C_{04}$ are formed in a triangle shape of which a vertex faces toward the confronting section 2E at the locations of the dividing pins $\mathbf{50}_{32}$ and $\mathbf{50}_{34}$ respectively. Locations of the dividing pins $\mathbf{50}_{3}$ are each vertex of the openings $\mathbf{2}C_{01}$ through $\mathbf{2}C_{04}$ respectively.

The distances "L1" and "L2" are assigned to be within a range of 20 to 35% and 55 to 70% of the length "L0" respectively. That is to say that the dividing pins $\mathbf{50}_{31}$ and $\mathbf{50}_{33}$ are inserted in a position allocated within the range of 20 to 35% of the total length of the horizontal deflection-coil 2 from the larger diameter flange 2B so as to form the openings $\mathbf{2}C_{01}$ and $\mathbf{2}C_{03}$, and that the dividing pins $\mathbf{50}_{32}$ and $\mathbf{50}_{34}$ are inserted in a position allocated within the range of 55 to 70% of the total length of the horizontal deflection coil 2 from the larger diameter flange 2B so as to form the other openings $\mathbf{2}C_{02}$ and $\mathbf{2}C_{04}$. In other words, the openings $\mathbf{2}C_{01}$ and $\mathbf{2}C_{03}$ are formed in the triangle shape of which vertex is allocated within the range of 20 to 35% of the total length of the horizontal deflection coil 2 from the larger diameter flange 2B, and the other openings $\mathbf{2}C_{02}$ and $\mathbf{2}C_{04}$ are formed in the triangle shape of which vertex is allocated within the range of 55 to 70% of the total length of the horizontal deflection coil 2 from the larger diameter flange 2B.

Further, as shown in FIG. 3, in a face perpendicularly intersecting the Z-axis, an angle between the X-axis and a line, which connects between the dividing pins $\mathbf{50}_{31}$ and $\mathbf{50}_{33}$ and the Z-axis, is defined as θ1, and another angle between the X-axis and a line, which connects between the dividing pins $\mathbf{50}_{32}$ and $\mathbf{50}_{34}$ and the Z-axis, is defined as θ2. These angles θ1 and θ2 are assigned to be within a range of 10 to 25 degrees and within a range of 25 to 40 degrees respectively. In other words, the openings $\mathbf{2}C_{01}$ and $\mathbf{2}C_{03}$ are formed in the triangle shape of which vertex is allocated within an angle of 10 to 25 degrees to the X-axis, and the other openings $\mathbf{2}C_{02}$ and $\mathbf{2}C_{04}$ are formed in the triangle shape of which vertex is allocated within an angle of 25 to 40 degrees to the X-axis.

Furthermore, an area adjacent to the larger diameter flange 2B on the side section 2C is divided into a plurality of sections. One area adjacent to the larger diameter flange 2B on the right side of the side section 2C, that is, one area allocated on the right side of the side section 2C in FIG. 3 is divided into a plurality of sections $\mathbf{2}C_{1}$, $\mathbf{2}C_{2}$, $\mathbf{2}C_{3}$, and $\mathbf{2}C_{4}$ by means of dividing pins $\mathbf{50}_{11}$, $\mathbf{50}_{12}$, $\mathbf{50}_{13}$, and $\mathbf{50}_{14}$. The other area adjacent to the larger diameter flange 2B on the left side of the side section 2C, that is, the other area allocated on the left side of the side section 2C in FIG. 3 is divided into a plurality of sections $\mathbf{2}C_{5}$, $\mathbf{2}C_{6}$, $\mathbf{2}C_{7}$, and $\mathbf{2}C_{8}$ by means of dividing pins $\mathbf{50}_{15}$, $\mathbf{50}_{16}$, $\mathbf{50}_{17}$, and $\mathbf{50}_{18}$. Hereinafter these dividing pins $\mathbf{50}_{11}$ through $\mathbf{50}_{18}$ are called dividing pins $\mathbf{50}_{1}$ generically. However, the dividing pins $\mathbf{50}_{1}$ are not shown in FIG. 2.

The above description is summarized as follows: in an area within a range of 20 to 35% on the Z-axis from the larger diameter flange 2B, the openings $\mathbf{2}C_{01}$, and $\mathbf{2}C_{03}$ are formed by inserting the dividing pins $\mathbf{50}_{31}$ and $\mathbf{50}_{33}$ in an angle of 10 to 25 degrees to the X-axis. Further, in another area within a range of 55 to 70% on the Z-axis from the larger diameter flange 2B, the other openings $\mathbf{2}C_{02}$ and $\mathbf{2}C_{04}$ are formed by inserting the dividing pins $\mathbf{50}_{32}$ and $\mathbf{50}_{34}$ in an angle of 25 to 40 degrees to the X-axis. Desirably, the openings $\mathbf{2}C_{01}$ and $\mathbf{2}C_{03}$ and the other openings $\mathbf{2}C_{02}$ and $\mathbf{2}C_{04}$ shall be formed within a range of 25 to 35% and in an angle of 12 to 20 degrees, and within a range of 60 to 70% and in an angle of 27 to 37 degrees respectively. More desirably, the openings $\mathbf{2}C_{01}$ and $\mathbf{2}C_{03}$ and the other openings $2C_{02}$ and $2C_{04}$ shall be formed within a range of 28 to 34% and in an angle of 14 to 18 degrees, and within a range of 62 to 68% and in an angle of 30 to 34 degrees respectively. These figures are found as optimum conditions for a compensating characteristic of the reversal trilemma through experiments and evaluations of the horizontal deflection coil 2 produced in various shapes.

A horizontal deflection magnetic field of a deflection yoke in a self-convergence system must be formed in a pin cushion shape. In the prior art, in order to improve a sensitivity of the "G" (green) to the "R" (red) and "B" (blue) and a distortion characteristic, it is commonly applied to the deflection yoke that the larger diameter flange 2B side, the smaller diameter flange 2A side, and a middle region from the larger diameter flange 2B to the smaller diameter flange 2A is formed as a strong pin cushion magnetic field, as a weak barrel magnetic field, and as an average pin cushion magnetic field respectively. The strong pin cushion magnetic field in the larger diameter flange 2B side causes the reversal trilemma.

In the present invention, forming the openings $2C_{01}$ through $2C_{04}$ by inserting the dividing pins $\mathbf{50}_{31}$ through $\mathbf{50}_{34}$ in the above-mentioned positions weakens the strong pin cushion magnetic field while the pin cushion magnetic field in the middle region from the larger diameter flange 2B to the smaller diameter flange 2A is strengthened. Accordingly, balance of a magnetic field distribution in the Z-axis is optimized, and then the reversal trilemma is improved. By installing the horizontal deflection coil 2 of the present invention into a deflection yoke for a 17-inch color picture tube, it is confirmed that the reversal trilemma is reduced by approximately 70% and improved by approximately 30%. The deflection yoke of which the reversal trilemma is improved by approximately 30% is superior to a deflection yoke adopting the improving method of the prior art.

According to the first embodiment of the present invention, the reversal trilemma can be improved without utilizing any circuit or component parts for compensating the reversal trilemma. While the present invention has been described above with reference to specific embodiment thereof, it is apparent that many changes, modifications and variations in the arrangement of components and devices and in materials can be made without departing from the invention concept disclose herein. For example, in order to compensate the reversal trilemma more, any other improving means such as a circuit and a component part can be utilized in addition to the horizontal deflection coil 2 of the present invention.

As mentioned above, the plural openings $2C_{01}$ through $2C_{04}$ are formed on the side section 2C of the horizontal deflection coil 2 constituting a deflection yoke of the present invention by regulating their positions by the plurality of dividing pins $\mathbf{50}_3$ during a winding process of the horizontal deflection coil 2. In the range of 20 to 30% of the length L0 between the larger diameter flange 2B and the smaller diameter flange 2A in the direction toward the smaller diameter flange 2A from the larger diameter flange 2B, the openings $2C_{01}$ and $2C_{03}$ (first opening) are formed by the dividing pins $\mathbf{50}_{31}$ and $\mathbf{50}_{33}$ (first dividing pin), which are provided within an angle of 10 to 25 degrees to the X-axis and the line connecting between the Z-axis and the dividing pins $\mathbf{50}_3$. The openings $2C_{02}$ and $2C_{04}$ (second opening) are formed by the dividing pins $\mathbf{50}_{32}$ and $\mathbf{50}_{34}$ (second dividing pin), which ate provided within an angle of 25 to 40 degrees to the X-axis and the line connecting between the Z-axis and the dividing pins $\mathbf{50}_3$.

[Second Embodiment]

Figure 4:
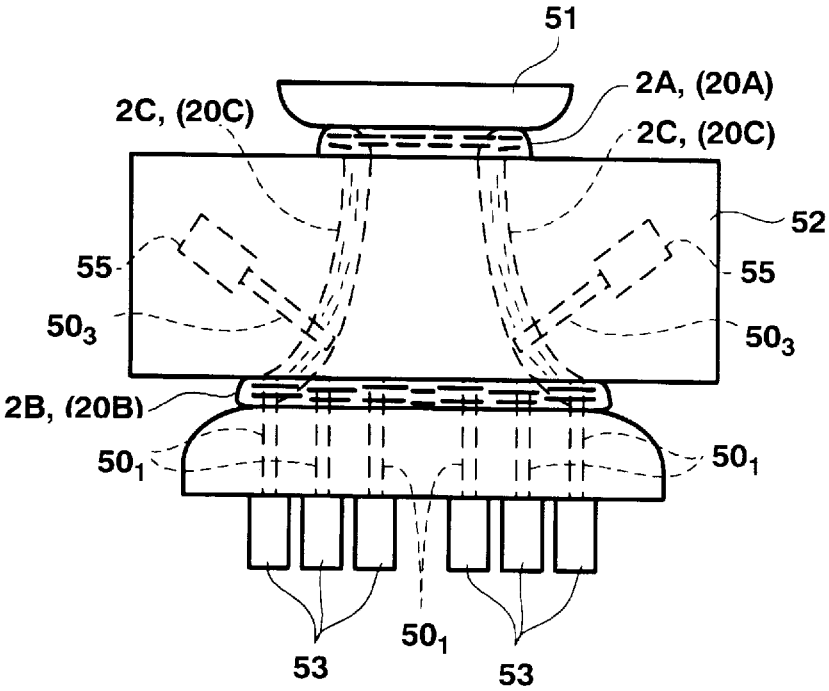
FIG. 4 is a side view of a winding apparatus of a deflection coil according to a second embodiment of the present invention.
Figure 5:
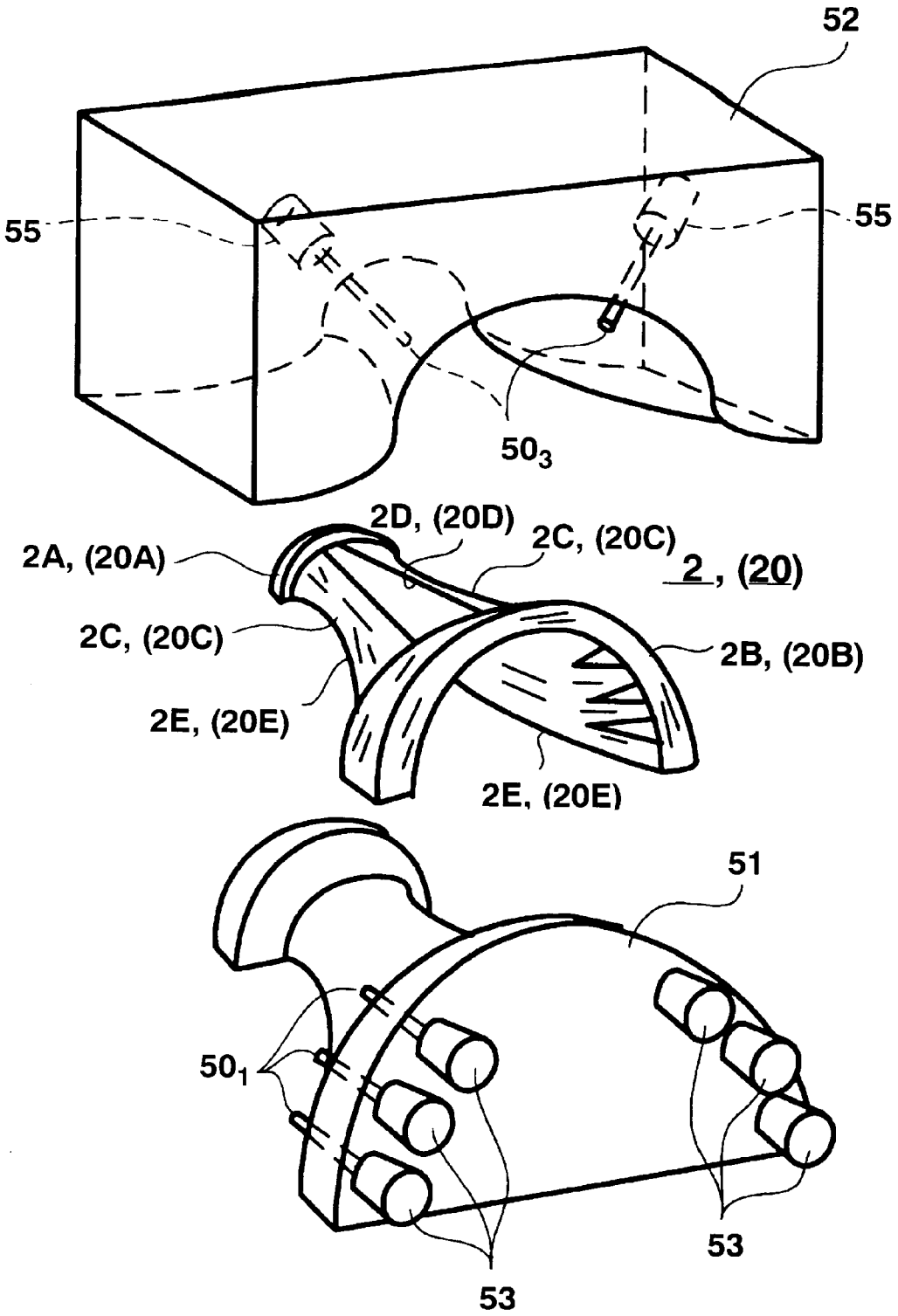
FIG. 5 is a perspective exploded view of the winding apparatus of a deflection coil shown in FIG. 4.

With referring to FIGS. 4 and 5, a winding apparatus and a winding method of the horizontal deflection coil 2 of the present invention is depicted next. The winding apparatus and the winding method of the present invention are characterized in a coil form of the winding apparatus, and other sections are the same as those of the prior art. Therefore, FIGS. 4 and 5 show only the coil form and other sections are not shown thereon. In addition thereto, reference symbols in parentheses are respective components of a horizontal deflection coil 20 of a third embodiment of the present invention. They are corresponding to those of the horizontal deflection coil 2 of the first embodiment of the present invention.

FIG. 4 is a side view of a winding apparatus of a deflection coil according to a second embodiment of the present invention.

FIG. 5 is a perspective exploded view of the winding apparatus of a deflection coil shown in FIG. 4.

In FIGS. 4 and 5, the coil form of the present invention comprises a convex form 51 and a concave form 52. When the convex and concave forms 51 and 52 are assembled with facing toward each other as shown in FIG. 4, a winding space is formed between them. A wire forming a coil is sequentially wound in the winding space, and then the horizontal deflection coil 2 in a saddle shape is formed.

As shown in FIGS. 4 and 5, the plurality of dividing pins $\mathbf{50}_1$ is provided on a larger diameter side (lower side of FIG. 4) of the convex form 51 so as to determine winding distribution of a wire and so as to divide the larger diameter flange 2B of the horizontal deflection coil 2 into the plurality of sections $2C_1$ through $2C_8$ when winding the horizontal deflection coil 2. Each of the dividing pins $\mathbf{50}_1$ is driven by respective driving sections 53. In other words, respective driving sections 53 is controlled so as for respective dividing pins $\mathbf{50}_1$ to drive to put in or out, that is, selectively to insert into or to shelter from the winding space between the convex and concave forms 51 and 52 during a winding process.

Further, the plurality of dividing pins $\mathbf{50}_3$ is provided on the concave form 52 so as to form the openings $2C_{01}$ through $2C_{04}$ in the triangle shape on the side section 2C of the horizontal deflection coil 2. The plurality of dividing pins $\mathbf{50}_3$ is controlled selectively to be inserted into or to be sheltered from the winding space by respective driving sections 55. In addition thereto, in order to simplify drawings, only a part of the plurality of dividing pins $\mathbf{50}_3$ and the driving sections 53 and 55 is shown in FIGS. 4 and 5.

In this embodiment, the dividing pins $\mathbf{50}_1$ are controlled to be put in or out to a direction, which is approximately parallel to the vertical direction of FIG. 4 equivalent to an axial direction or the Z-axis of a color picture tube (not shown), and the dividing pins $\mathbf{50}_3$ are controlled to be put in or out approximately to a normal line of the side section 2C, for example. Hereinafter these dividing pins $\mathbf{50}_1$ and $\mathbf{50}_3$ are referred to dividing pins 50 generically.

As mentioned above, according to the winding apparatus and the winding method of the present invention, a wire is wound in the winding space between the convex and concave forms 51 and 52, and the horizontal deflection coil 2 is formed such that one end toward a neck side of a color picture tube is formed as the smaller diameter flange 2A, the other end toward a screen side of the color picture tube is formed as the larger diameter flange 2B, and a connecting area between the smaller and larger diameter flanges 2A and 2B is formed as the side section 2C. Further, winding distribution on the side section 2C is regulated by inserting the plurality of dividing pins $\mathbf{50}_3$ into the winding space when winding.

Furthermore, in the range of 20 to 35% of the length L0 between the larger and smaller diameter flanges 2B and 2C in the direction toward the smaller diameter flange 2A from the larger diameter flange 2B, the dividing pins $\mathbf{50}_{31}$ and $\mathbf{50}_{33}$ (first dividing pin) are inserted in an angle of 10 to 25 degrees to the X-axis and the line connecting between the Z-axis and the dividing pins $\mathbf{50}_{3}$. In the range of 55 to 70% of the length L0 between the larger and smaller diameter flanges 2B and 2C in the direction toward the smaller diameter flange 2A from the larger diameter flange 2B, the dividing pins $\mathbf{50}_{32}$ and $\mathbf{50}_{34}$ (second dividing pin) are inserted in an angle of 25 to 40 degrees to the X-axis and the line connecting between the Z-axis and the dividing pins $\mathbf{50}_{3}$.

Figure 6:
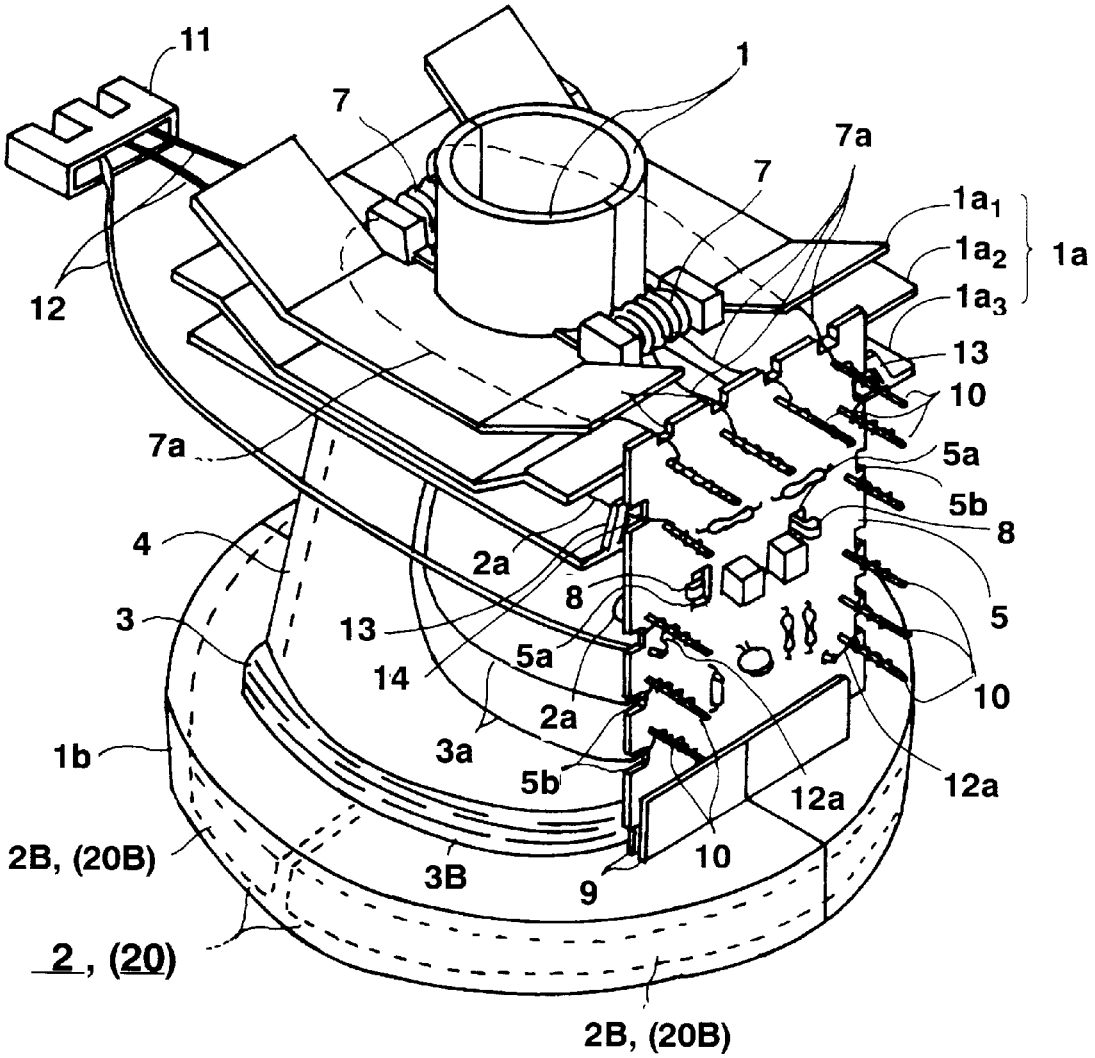
FIG. 6 is a perspective view of a total construction of a deflection yoke according to the present invention.

With referring to FIG. 6, an example of total construction of a deflection yoke of the present invention is depicted.

FIG. 6 is a perspective view of a total construction of a deflection yoke according to the present invention. The example of total construction shown in FIG. 6 includes some components, which are not directly related to the present invention. Further, reference symbols in parentheses are respective components of the horizontal deflection coil 20 of the third embodiment of the present invention. Furthermore, the deflection yoke of the present invention is not limited to the one shown in FIG. 6. In FIG. 6, the deflection yoke is formed like a funnel shape such that one end toward the top is a smaller diameter section and the other end toward bottom is a larger diameter section by means of a separator 1, which is combined with, for example, a pair of semiannular members, wherein the smaller diameter section is allocated to a neck portion of a color picture tube and the larger diameter section to a screen side of the color picture tube.

A pair of saddle shaped horizontal deflection coils 2 is mounted on an inner surface of the separators 1 and a pair of saddle shaped vertical deflection coils 3 is mounted on an outer surface of the separators 1. The separators 1 hold the horizontal and vertical deflection coils 2 and 3 with electrical insulation. A core 4 of magnetic material such as ferrite is mounted on an outer surface of the vertical deflection coils 3. The horizontal deflection coil 2 is formed by the winding apparatus and the winding method of the present invention and constituted as shown in FIGS. 2 and 3.

As mentioned above, the horizontal deflection coil 2 is provided with the smaller diameter flange 2A (not shown in FIG. 6) and the larger diameter flange 2B. The smaller diameter flange 2A is contained in a container section (not shown) provided on the smaller diameter section of the separator 1 and the larger diameter flange 2B is contained in a larger diameter side flange 1*b* of the separator 1. The vertical deflection coil 3 is also provided with a smaller diameter side flange (not shown) and a larger diameter side flange 3B.

Usually a circuit for compensating a deflection characteristic is necessary for such the deflection yoke constituted as mentioned above. A circuit board 5 installed with such the circuit is mounted on a side of the separator 1. A smaller diameter side flange 1*a* composed of a plurality of flanges $\mathbf{1}a_1$, $\mathbf{1}a_2$, and $\mathbf{1}a_3$ is provided on the smaller diameter side of the separator 1. A pair of four pole compensating coil 7, which is called a 4P coil, is fixed on the outermost flange $\mathbf{1}a_1$, of the smaller diameter side flange 1*a*.

A craw 8 for mounting the circuit board 5 on the separator 1 is formed in conjunction with the innermost flange $\mathbf{1}a_3$. The circuit board 5 is provided with a hole 5*a*, and the craw 8 provided on the innermost flange $\mathbf{1}a_3$ is engaged with the hole 5*a*. On the other hand, a pair of board like ribs 9 is provided on the larger diameter side flange 1*b* formed in conjunction with the larger diameter side flange 1*b*. The circuit board 5 is held with being engaged with the ribs 9. Accordingly, the circuit board 5 is mounted on the side of the separator 1 by means of the craw 8 provided on the innermost flange $\mathbf{1}a_3$ and the ribs 9.

Further, a plurality of pins 10 as a terminal for connecting a lead wire is mounted on the circuit board 5 and twined with a lead wire 2*a* from the horizontal deflection coil 2, a lead wire 3*a* from the vertical deflection coil 3, and a lead wire 7*a* from the compensating coil 7. Furthermore, a connector 11, which is connected to a power supply so as to supply current to the deflection yoke, is connected with connector wires 12. A lead wire 12*a* of the connector wires 12 is twined with the pin 12 on the circuit board 5.

A plurality of grooves 5*b* for passing the lead wires 2*a*, 3*a*, and 7*a* is provided on both edges of the circuit board 5. The lead wires 2*a*, 3*a*, and 7*a* led to the circuit board 5 are contained in the respective grooves 5*b* and twined with respective pins 10, and then soldered. However, solder itself is not shown in FIG. 6. An L-shaped rib 13 is provided with being formed in conjunction with the innermost flange $\mathbf{1}a_3$. The lead wire 2*a* from the horizontal deflection coil 2 is contained in the groove 5*b* through a C-shaped concave section 14, which is formed by the rib 13 and the innermost flange $\mathbf{1}a_3$.

[Third Embodiment]

According to a third embodiment of the present invention, flexibility of designing winding distribution of a deflection coil can be increased, and a convergence characteristic and a deflection distortion characteristic can be improved. A winding apparatus of a deflection coil in the third embodiment is the same as that shown in FIGS. 4 and 5. The deflection coil of the third embodiment can be applied to both horizontal and vertical deflection coils. Hereinafter a horizontal deflection coil is explained as an example of the deflection coil of the third embodiment of the present invention.

Figure 7:
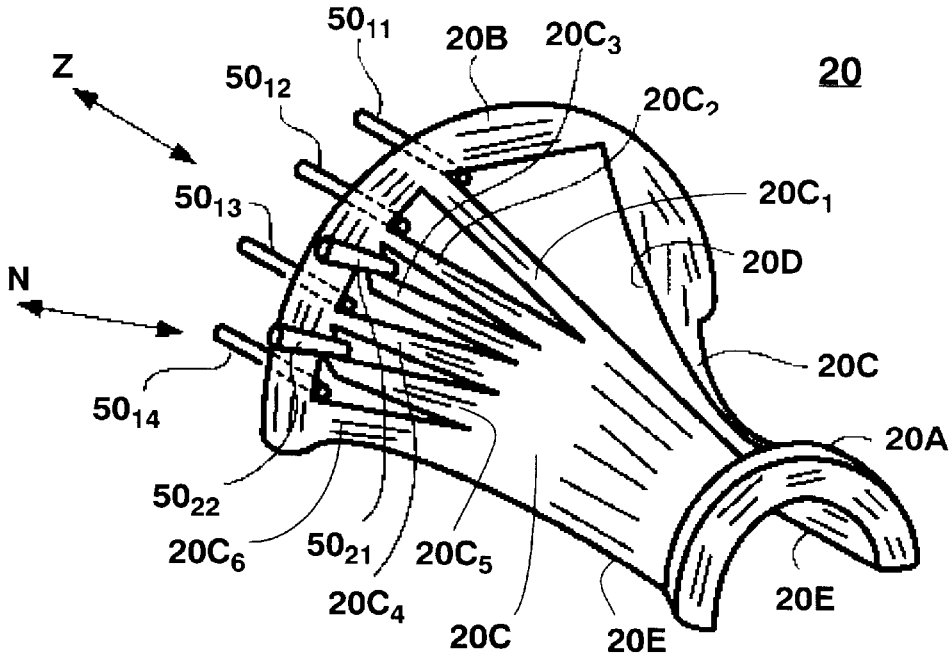
FIG. 7 is a perspective view of a deflection coil formed with a plurality of dividing sections, which is produced by the winding apparatus and a winding method of a deflection coil according to a third embodiment of the present invention.
Figure 8:
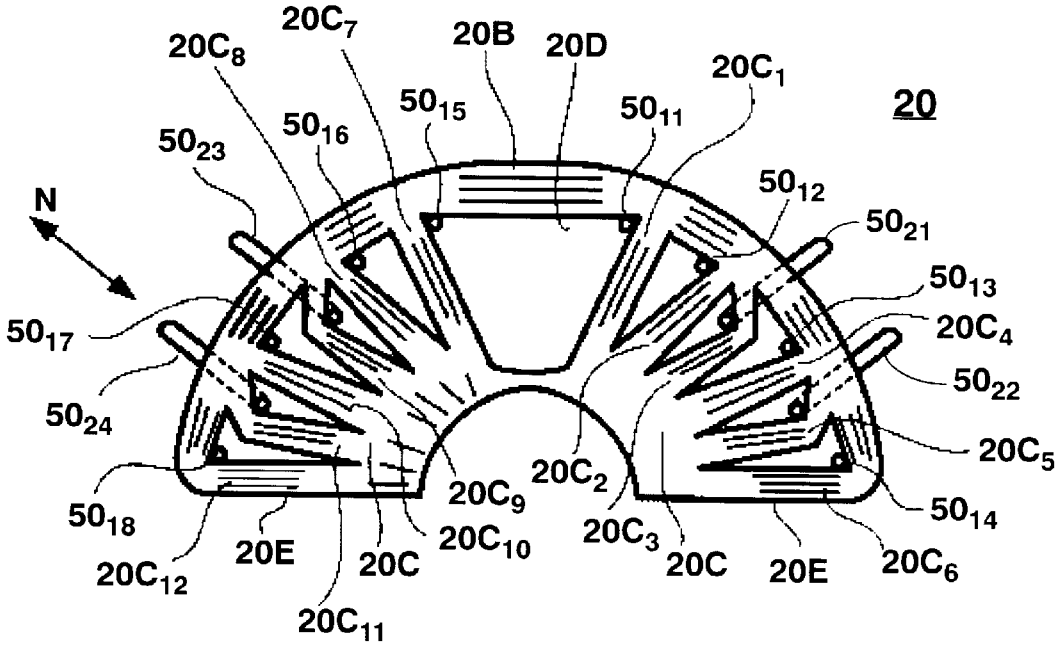
FIG. 8 is a front plan view of the deflection coil shown in FIG. 7.

Further detail of a constitution of the horizontal deflection coil produced by the winding apparatus and the winding method of the present invention is depicted with referring to FIGS. 7 and 8.

FIG. 7 is a perspective view of a deflection coil formed with a plurality of dividing sections, which is produced by the winding apparatus and the winding method of the deflection coil according to the third embodiment of the present invention, and FIG. 8 is a front plan view of the deflection coil shown in FIG. 7. In FIGS. 7 and 8, a horizontal deflection coil 20 comprises a flange in a smaller diameter or a smaller diameter flange 20A, another flange in a larger diameter or a larger diameter flange 20B, a side section 20C connecting between the smaller diameter flange 20A and the larger diameter flange 20B, a window section 20D, a confronting section 20E, a plurality of openings $2C_1$, through $2C_{12}$, and a plurality of dividing pins $\mathbf{50}_{11}$ through $\mathbf{50}_{18}$ and $\mathbf{50}_{21}$ through $\mathbf{50}_{24}$ (hereinafter referred to dividing pins 50 generically). In FIG. 7, some of the dividing pins 50 provided on the larger diameter flange 20B and the side section 20C and some of sections divided by the dividing pins 50 are omitted so as to simplify the drawing.

The third embodiment of the present invention is characterized in that at least three adjacent dividing pins 50 out of, at least, a part of the plurality of dividing pins 50 are put in or out in different directions alternately. In this third embodiment dividing pins $\mathbf{50}_2$ ($\mathbf{50}_{21}$ through $\mathbf{50}_{24}$) are provided inside the concave form 52 as a preferable embodiment of the dividing pins 50, which are put in or out to a different direction from the direction of dividing pins 501 ($\mathbf{50}_{11}$ through $\mathbf{50}_{18}$).

The winding apparatus of the present invention determines winding distribution of a wire and is provided with a winding form equipped with the plurality of the dividing pins 50 for dividing the side section 20C of the horizontal deflection coil 20 into a plurality of sections. The winding apparatus is further characterized in that the dividing pins 50 for forming three adjacent sections out of at least a part of the plurality of sections are constituted so as to be put in or out from different directions alternately. Furthermore, a winding method of the present invention determines the winding distribution of a wire by the plurality of the dividing pins 50. The winding method is further characterized in that the dividing pins 50 for forming three adjacent sections out of at least a part of the plurality of sections are constituted so as to be put in or out from different directions alternately when dividing the side section 20C into the plurality of sections.

According to the winding apparatus and the winding method of the present invention, the driving sections 53 and the driving sections 55 are provided in separate sections, so that interference between the driving sections 53 and the driving sections 55 is not necessary to be considered. Therefore, a gap between the dividing pins 50 can be reduced as far as respective driving pins 50 driven by the driving sections 53 and 55 do not interfere with each other. Accordingly, flexibility of designing winding distribution of a deflection coil can be extremely improved such that a number of dividing sections can be increased and a gap between adjacent dividing sections can be drastically reduced.

Referring back to FIGS. 7 and 8, the driving pins 501 provided on the right half side of the convex form 51 shown in FIG. 5 are composed of driving pins $\mathbf{50}_{11}$, $\mathbf{50}_{12}$, $\mathbf{50}_{13}$, and $\mathbf{50}_{14}$ and they are allocated in the right half side of the side section 20C with viewing from the larger diameter flange 20B side as shown in FIG. 8 or in the left half side of the side section 20C with viewing from the smaller diameter flange 20A side as shown in FIG. 7. The dividing pins $\mathbf{50}_1$ are inserted in the axial direction "Z". The driving pins $\mathbf{50}_2$ provided on the concave form 52 are composed of driving pins $\mathbf{50}_{21}$ and $\mathbf{50}_{22}$ and allocated in the right half side of the side section 20C with viewing from the larger diameter flange 20B side as shown in FIG. 8 or in the left half side of the side section 20C with viewing from the smaller diameter flange 20A side as shown in FIG. 7. The dividing pins $\mathbf{50}_2$ are inserted in the normal line "N" of the side section 20C. On the other hand, in the left half side of the sided section 20C as shown in FIG. 8, the driving pins $\mathbf{50}_1$ provided on the convex form 51 are composed of driving pins $\mathbf{50}_{15}$, $\mathbf{50}_{16}$, $\mathbf{50}_{17}$, and $\mathbf{50}_{18}$ and are inserted in the axial direction "Z". The driving pins $\mathbf{50}_2$ provided on the concave form 52 are composed of driving pins $\mathbf{50}_{23}$ and $\mathbf{50}_{24}$ are inserted in the normal line "N" of the side section 20C.

Further, the right half side of the larger diameter flange 20B side of the side section 20C shown in FIG. 8 is divided into a plurality of sections $\mathbf{20}C_1$ through $\mathbf{20}C_6$ by the dividing pins $\mathbf{50}_{11}$ through $\mathbf{50}_{14}$ and $\mathbf{50}_{21}$ and $\mathbf{50}_{22}$. On the other hand, the left half side of the larger diameter flange 20B side of the side section 20C is divided into a plurality of sections $\mathbf{20}C_7$ through $\mathbf{20}C_{12}$ by the dividing pins $\mathbf{50}_{15}$ through $\mathbf{50}_{18}$ and $\mathbf{50}_{23}$ and $\mathbf{50}_{24}$. The sections $\mathbf{20}C_2$ through $\mathbf{20}C_6$ divided by the dividing pins $\mathbf{50}_{12}$ through $\mathbf{50}_{14}$ are divided by inserting the dividing pins $\mathbf{50}_{12}$ through $\mathbf{50}_{14}$ into different directions from each direction alternately. Furthermore, the sections $\mathbf{20}C_8$ through $\mathbf{20}C_{12}$ divided by the dividing pins $\mathbf{50}_{16}$, through $\mathbf{50}_{18}$ are divided by inserting the dividing pins $\mathbf{50}_{16}$ through $\mathbf{50}_{18}$ into different directions from each direction alternately.

According to the horizontal deflection coil 20 of the present invention, more sections or sections in narrower gaps can be formed on the side section 20C within the area from the window section 20D to the confronting section 20E. Accordingly, in a deflection yoke equipped with the horizontal deflection coil 20 of the present invention, a characteristic in high accuracy satisfying a strict demand for the convergence and deflection distortion characteristics can be obtained. In addition thereto, an example of total constitution of the deflection yoke equipped with the horizontal deflection coil 20 of the third embodiment of the present invention is shown in FIG. 6.

According to an aspect of the present invention, there provided a horizontal deflection coil, which can improve the reversal trilemma without utilizing a circuit or a component part for compensating the reversal trilemma, wherein a winding apparatus and a winding method of the horizontal deflection coil of the present invention regulates winding distribution of a wire in a side section by inserting a plurality of dividing pins into a winding space when the wire is wound. The plurality of dividing pins are constituted such that within a range of 20 to 35% of a length between a larger diameter section and a smaller diameter section in a direction from the larger diameter section to the smaller diameter section, a first dividing pin is inserted in an angle of 10 to 25 degrees to a horizontal axis of a screen of a color picture tube and a line connecting between the first dividing pin and an axial line of the color picture tube with viewing from a cross section at a position of inserting the first dividing pin into the winding space, and further such that within a range of 55 to 70% of the length between the larger diameter section and the smaller diameter section in the direction from the larger diameter section to the smaller diameter section, a second dividing pin is inserted in an angle of 25 to 40 degrees to the horizontal axis of the screen and another line connecting between the second dividing pin and an axial line of the color picture tube with viewing from a cross section at a position of inserting the second dividing pin into the winding space.

According to another aspect of the present invention, there provided a deflection yoke, which can improve the reversal trilemma without utilizing a circuit or a component part for compensating the reversal trilemma, wherein a plurality of openings are provided on a side section of a horizontal deflection coil of the deflection yoke of the present invention by regulating a location of winding by means of a plurality of dividing pins during a process of winding the horizontal deflection coil. The plurality of openings are constituted such that within a range of 20 to 35% of a length between a larger diameter section and a smaller diameter section in a direction from the larger diameter section to the smaller diameter section, a first opening formed by a first dividing pin, which is inserted in an angle of 10 to 25 degrees to a horizontal axis of a screen of a color picture tube and a line connecting between the first dividing pin and an axial line of the color picture tube with viewing from a cross section at a position of inserting the first dividing pin into the winding space, and further such that within a range of 55 to 70% of the length between the larger diameter section and the smaller diameter section in the direction from the larger diameter section to the smaller diameter section, a second opening formed a second dividing pin, which is inserted in an angle of 25 to 40 degrees to the horizontal axis of the screen and another line connecting between the second dividing pin and an axial line of the color picture tube with viewing from a cross section at a position of inserting the second dividing pin into the winding space.

According to a further aspect of the present invention, there provided a winding apparatus and a winding method of a deflection coil of the present invention, which can increase a flexibility of designing winding distribution of the deflection coil and can improve a convergence characteristic and a deflection distortion characteristic. The winding apparatus and the winding method of the deflection coil of the present invention regulate winding distribution of a wire by inserting a dividing pin into a winding space when the wire is wound. When the deflection coil is divided into a plurality of sections, the dividing pin for forming three adjacent sections in at least a part of the plurality of sections is inserted into the winding space in different directions alternately in accordance with the winding apparatus and the winding method of the present invention.

According to a furthermore aspect of the present invention, there provided a deflection yoke, which can improve a convergence characteristic and a deflection distortion characteristic. A side section of a deflection coil in the deflection yoke of the present invention is divided into a plurality of sections by regulating a position of a winding by means of a plurality of dividing pins during a process of winding. Three adjacent sections in at least a part of the plurality of sections are divided by a dividing pin, which is inserted in different directions alternately, so that a number of sections can be increased and a gap between sections can be narrowed.

What is claimed is:

1. A winding apparatus having a convex form and a concave form for forming a horizontal deflection coil utilized for a deflection yoke being mounted on a neck portion of a color picture tube, wherein said horizontal deflection coil is formed by winding a wire in a winding space between said convex form and said concave form, said neck portion corresponding to a smaller diameter section, a screen side of said color picture tube corresponding to a larger diameter section, and an area connecting said smaller diameter section and said larger diameter section as a side section, said winding apparatus comprising:

a plurality of dividing pins of regulating winding distribution in said side section by being inserted in said winding space while winding said wire, said plurality of dividing pins further comprising:

a first dividing pin being provided within a range of 20 to 35% of a length between said larger diameter section and said smaller diameter section in a direction from said larger diameter section to said smaller diameter section and within an angle of 10 to 25 degrees to a horizontal axis of said screen and a line connecting said first dividing pin and an axial line of said color picture tube viewed from a cross section at a position of inserting said first dividing pin in said winding space; and a second dividing pin being provided within a range of 55 to 70% of a length between said larger diameter section and said smaller diameter section in a direction from said larger diameter section to said smaller diameter section and within an angle of 25 to 40 degrees to the horizontal axis of said screen and a line connecting said second dividing pin and the axial line of said color picture tube viewed from a cross section at a position of inserting said second dividing pin in said winding space.

2. A winding method for forming a horizontal deflection coil utilized for a deflection yoke being mounted on a neck portion of a color picture tube, wherein said horizontal deflection coil is formed by winding a wire in a winding space between a convex form and a concave form, said neck portion corresponding to a smaller diameter section, a screen side of said color picture tube corresponding to a larger diameter section, and an area connecting said smaller diameter section and said larger diameter section as a side section, said winding method regulating winding distribution in said side section by inserting a plurality of dividing pins in said winding space while winding said wire, and said plurality of dividing pins further comprising:

a first dividing pin being inserted within a range of 20 to 35% of a length between said larger diameter section and said smaller diameter section in a direction from said larger diameter section to said smaller diameter section and within an angle of 10 to 25 degrees to a horizontal axis of said screen and a line connecting said first dividing pin and an axial line of said color picture tube viewed from a cross section at a position of inserting said first dividing pin in said winding space; and a second dividing pin being inserted within a range of 55 to 70% of a length between said larger diameter section and said smaller diameter section in a direction from said larger diameter section to said smaller diameter section and within an angle of 25 to 40 degrees to the horizontal axis of said screen and a line connecting said second dividing pin and the axial line of said color picture tube viewed from a cross section at a position of inserting said second dividing pin in said winding space.

3. A deflection yoke of being mounted on a neck portion of a color picture tube and equipped with a horizontal deflection coil, said neck portion corresponding to a smaller diameter section, a screen side of said color picture tube corresponding to a larger diameter section, and an area connecting said smaller diameter section and said larger diameter section as a side section, said horizontal deflection coil comprising:

a plurality of openings being formed on said side section by regulating allocations of a plurality of dividing pins while a winding process of said horizontal deflection coil, said plurality of openings further comprising:

a first opening being provided within a range of 20 to 35% of a length between said larger diameter section and said smaller diameter section in a direction from said larger diameter section to said smaller diameter section and within an angle of 10 to 25 degrees to a horizontal axis of said screen and a line connecting between said plurality of dividing pins and an axial line of said color picture tube viewed from a cross section at a position of inserting said plurality of dividing pins in a winding space; and a second opening being provided within a range of 55 to 70% of a length between said larger diameter section and said smaller diameter section in a direction from said larger diameter section to said smaller diameter section and within an angle of 25 to 40 degrees to a horizontal axis of said screen and a line connecting said plurality of dividing pins and the axial line of said color picture tube viewed from a cross section at a position of inserting said plurality of dividing pins in said winding space.

4. A winding apparatus having a convex form and a concave form for forming a deflection coil being formed by winding a wire in a winding space between said convex form and said concave form, said winding apparatus comprising:

at least one first dividing pin provided in said convex form and inserted into said winding space from a first direction for regulating winding distribution when winding said wire; and at least two second dividing pins provided in said concave form and inserted into said winding space from a second direction different from said first direction for regulating winding distribution when winding said wire, wherein said at least one first dividing pin and said at least two second dividing pins are inserted into said winding space alternately and divide said deflection coil into at least three sections.

5. A winding apparatus having a convex form and a concave form for forming a deflection coil being formed by winding a wire in a winding space between said convex form and said concave form, said winding apparatus comprising:

at least two first dividing pins provided in said convex form and inserted into said winding space from a first direction for regulating winding distribution when winding said wire; and at least one second dividing pin provided in said concave form and inserted into said winding space from a second direction different from said first direction for regulating winding distribution when winding said wire, therein said at least two first dividing pins and said at least one second dividing pin are inserted into said winding space alternately and divide said deflection coil into at least three sections.

6. A winding method for forming a deflection coil by winding a wire in a winding space between a convex form and a concave form, said winding method comprising steps of:

regulating winding distribution by inserting at least one first dividing pin provided in said convex form into said winding space from a first direction when winding said wire; and regulating winding distribution by inserting at least two second dividing pins provided in said concave form into said winding space from a second direction different from said first direction when winding said wire, wherein said at least one first dividing pin and said at least two second dividing pins are inserted into said winding space alternately and divide said deflection coil into at least three sections.

7. A winding method for forming a deflection coil by winding a wire in a winding space between a convex form and a concave form, said winding method comprising steps of:

regulating winding distribution by inserting at least two first dividing pins provided in said convex form into said winding space from a first direction when winding said wire; and regulating winding distribution by inserting at least one second dividing pin provided in said concave form into said winding space from a second direction different from said first direction when winding said wire, wherein said at least two first dividing pins and said at least one second dividing pin are inserted into said winding space alternately and divide said deflection coil into at least three sections.

8. A deflection yoke mounted on a neck portion of a color picture tube and equipped with a deflection coil of being referred having a smaller diameter section associated with the neck portion, a larger diameter section associated with a screen side, and an area connecting said smaller diameter section and said larger diameter section as a side section, wherein said deflection coil is formed by a winding apparatus comprising a convex form having at least one first dividing pin and a concave form having at least two second dividing pins for winding a wire in a winding space between said convex form and said concave form, and wherein said side section of said deflection coil is divided into at least three sections by inserting said at least one first dividing pin and said at least two second dividing pins into said winding space alternately during a process of winding said deflection coil by said winding apparatus.

9. A deflection yoke mounted on a neck portion of a color picture tube and equipped with a deflection coil of being referred having a smaller diameter section associated with the neck portion, a larger diameter section associated with a screen side, and an area connecting said smaller diameter section and said larger diameter section as a side section, wherein said deflection coil is formed by a winding apparatus comprising a convex form having at least two first dividing pins and a concave form having at least one second dividing pin for winding a wire in a winding space between said convex form and said concave form, and wherein said side section of said deflection coil is divided into at least three sections by inserting said at least two first dividing pins and said at least one second dividing pin into said winding space alternately during a process of winding said deflection coil by said winding apparatus.

* * * * *